US006314605B1

(12) United States Patent
Solanki et al.

(10) Patent No.: US 6,314,605 B1
(45) Date of Patent: Nov. 13, 2001

(54) TOOTHBRUSH

(75) Inventors: Sanjay Amratlal Solanki, Egham; Simon Phillip Shenton, Slough, both of (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/230,856

(22) PCT Filed: Aug. 1, 1997

(86) PCT No.: PCT/US97/12855

§ 371 Date: Feb. 26, 1999

§ 102(e) Date: Feb. 26, 1999

(87) PCT Pub. No.: WO98/05240

PCT Pub. Date: Feb. 12, 1998

(30) Foreign Application Priority Data

Aug. 2, 1996 (GB) ..... 9616326

(51) Int. Cl.[7] ..... A46B 9/04
(52) U.S. Cl. ..... 15/167.1; 15/201
(58) Field of Search ..... 15/167.1, 201

(56) References Cited

U.S. PATENT DOCUMENTS

| | | | |
|---|---|---|---|
| D. 248,696 | 8/1978 | Greenberg | 4/104 D |
| D. 259,976 | 7/1981 | Seelig | 4/104 D |
| D. 272,688 | 2/1984 | Stocchi | 4/110 D |
| D. 272,689 | 2/1984 | Stocchi | 4/110 D |
| D. 272,690 | 2/1984 | Stocchi | 4/110 D |
| D. 273,635 | 5/1984 | Stocchi | 4/104 D |
| D. 276,193 | 11/1984 | Tanabe et al. | 4/104 D |
| D. 285,263 | 8/1986 | Hill | 4/104 D |
| D. 289,703 | 5/1987 | Yaffe | 4/104 D |
| D. 289,704 | 5/1987 | Marthaler et al. | 4/104 D |
| D. 292,448 | 10/1987 | Vianello | 4/104 D |
| D. 319,148 | 8/1991 | Emily | 4/104 D |
| D. 324,775 | 3/1992 | Kreisher et al. | 4/104 D |
| D. 342,160 | 12/1993 | Curtis et al. | 4/104 D |
| D. 342,162 | 12/1993 | Curtis et al. | 4/104 D |

(List continued on next page.)

FOREIGN PATENT DOCUMENTS

| | | |
|---|---|---|
| 460705 | 10/1968 | (CH) . |
| 3737223A1 | 5/1989 | (DE) . |
| 9318148 | 5/1994 | (DE) . |
| 9400926 | 5/1994 | (DE) . |
| 0 336 641A2 | 10/1989 | (EP) . |

(List continued on next page.)

*Primary Examiner*—Mark Spisich
(74) *Attorney, Agent, or Firm*—James C. Vago; Karen F. Clark

(57) ABSTRACT

A toothbrush having a handle and, attached at one end thereof, a head (1), the head (1) having a handle end (4), a free end (2), and a bristle-bearing face (7) with a plurality of tufts (6) extending therefrom, the tufts (6) each having a base and a free end and comprising one or more bristles, wherein the tufts (6) are arranged in groups which are separated from each other by a transverse gap (8), the distance between the bases of the tufts (6) within a group being less than 1.3 mm, the distance between the bases of the tufts (6) between groups being in the range from 1.3 mm to 5 mm and wherein the distance between the free ends of the tufts between groups is preferably at least 0.5 mm. Preferably, each group is in the form of a crescent shaped array and tufts (6) are generally perpendicular to the toothbrush head (1). The arrangement allows for independent movement of bristle tufts (6), particularly whilst using the Bass or Rolling techniques for toothbrushing, yet maintains a high density of tufts (6) on the toothbrush head (1).

15 Claims, 2 Drawing Sheets

U.S. PATENT DOCUMENTS

| | | | | |
|---|---|---|---|---|
| D. 351,732 | | 10/1994 | Dair et al. | 4/104 D |
| D. 360,760 | | 8/1995 | Holm | 4/104 D |
| D. 391,769 | | 3/1998 | Kling et al. | 4/104 D |
| 669,402 | | 3/1901 | Rose | 15/167.1 |
| 759,490 | | 5/1904 | Yates | 15/143.1 |
| 876,317 | | 1/1908 | Booth | 40/314 |
| 914,501 | | 3/1909 | McEachern | 401/268 |
| 1,018,927 | | 2/1912 | Sarrazin | 15/167.1 |
| 1,337,173 | | 4/1920 | White | 15/176.1 |
| 1,440,785 | | 1/1923 | Levis | 15/167.1 |
| 1,456,535 | | 5/1923 | Cartwright | 15/176.4 |
| 1,642,465 | | 9/1927 | Sheetz | 15/167.1 |
| 1,724,955 | * | 8/1929 | Mitchell | 15/167.1 |
| 1,860,924 | | 5/1932 | Cooke | 15/167.1 |
| 1,901,646 | | 3/1933 | Hicks | 15/167.1 |
| 1,927,365 | | 9/1933 | Frolio | 15/167.1 |
| 2,003,243 | | 5/1935 | Campbell et al. | 15/167.1 |
| 2,122,619 | | 7/1938 | McMath | 15/167.1 |
| 2,154,352 | | 4/1939 | Peterson | 15/167.1 |
| 2,172,624 | | 9/1939 | Robert | 15/167.1 |
| 2,179,266 | | 11/1939 | Lukenbill | 15/145 |
| 2,242,743 | | 5/1941 | Brown | 15/167.1 |
| 2,254,365 | | 9/1941 | Griffith et al. | 15/172 |
| 2,266,195 | | 12/1941 | Hallock | 15/167.1 |
| 2,274,042 | | 2/1942 | Cosby | 15/167.1 |
| 2,326,632 | | 8/1943 | Friedman | 15/176.4 |
| 2,438,268 | | 3/1948 | Bressler | 15/167.1 |
| 2,443,297 | | 6/1948 | Bressler | 15/167.1 |
| 2,650,383 | | 9/1953 | Bressler | 15/167.1 |
| 2,676,350 | | 4/1954 | Bressler | 15/167.1 |
| 2,685,703 | | 8/1954 | Dellenbach | 15/167.1 |
| 2,722,031 | | 11/1955 | Bressler | 15/201 |
| 2,807,820 | | 10/1957 | Dinhofer | 15/176.1 |
| 3,082,457 | | 3/1963 | Lucibello et al. | 15/167.1 |
| 3,129,449 | | 4/1964 | Cyzer | 15/28 |
| 3,152,349 | | 10/1964 | Brennesholtz | 15/167.1 |
| 3,188,672 | | 6/1965 | Gary | 15/167.1 |
| 3,188,673 | | 6/1965 | Newman | 15/167.1 |
| 3,253,292 | | 5/1966 | Herschensohn | 15/201 |
| 3,378,870 | | 4/1968 | Matsunaga | 15/167.1 |
| 3,398,421 | | 8/1968 | Rashbaum | 15/167.1 |
| 3,583,019 | | 6/1971 | Conklin, Jr. | 15/167.1 |
| 3,678,528 | | 7/1972 | Haije | 15/167.1 |
| 3,722,020 | | 3/1973 | Hills | 15/167.1 |
| 3,742,549 | | 7/1973 | Scopp et al. | 15/167.1 |
| 3,792,504 | | 2/1974 | Smith | 15/167.1 |
| 4,020,521 | | 5/1977 | Velasquez | 15/172 |
| 4,031,587 | | 6/1977 | Dietrich | 15/167.1 |
| 4,081,876 | | 4/1978 | Pugh | 15/167.1 |
| 4,240,452 | | 12/1980 | Jean | 15/167.1 |
| 4,283,808 | | 8/1981 | Beebe | 15/145 |
| 4,288,883 | | 9/1981 | Dolinsky | 15/110 |
| 4,488,328 | | 12/1984 | Hyman | 15/167.1 |
| 4,520,526 | | 6/1985 | Peters | 15/167.1 |
| 4,570,282 | | 2/1986 | Kaufman et al. | 15/167.1 |
| 4,573,920 | | 3/1986 | d'Argembeau | 433/141 |
| 4,633,542 | | 1/1987 | Taravel | 15/167.1 |
| 4,646,381 | | 3/1987 | Weihrauch | 15/167.1 |
| 4,691,405 | | 9/1987 | Reed | 15/201 |
| 4,694,844 | | 9/1987 | Berl et al. | 15/167.1 |
| 4,712,267 | | 12/1987 | Cheng | 15/172 |
| 4,766,054 | | 8/1988 | Rauch | 15/167.1 |
| 4,800,608 | | 1/1989 | Key | 15/167.1 |
| 4,829,621 | | 5/1989 | Phenegar | 15/172 |
| 4,847,936 | | 7/1989 | Moglianesi et al. | 15/167.1 |
| 4,864,676 | | 9/1989 | Schaiper | 15/167.1 |
| 4,882,803 | | 11/1989 | Rogers et al. | 15/167.1 |
| 4,894,880 | | 1/1990 | Aznavoorian | 15/167.2 |
| 5,014,383 | | 5/1991 | Costar | 15/160 |
| 5,046,212 | | 9/1991 | O'Conke | 15/105 |
| 5,046,213 | | 9/1991 | Curtis et al. | 15/167.1 |
| 5,052,071 | | 10/1991 | Halm | 15/167.1 |
| 5,054,154 | | 10/1991 | Schiffer et al. | 15/167.1 |
| 5,114,214 | | 5/1992 | Barman | 300/21 |
| 5,242,235 | | 9/1993 | Li | 401/268 |
| 5,305,489 | | 4/1994 | Lage | 15/167.1 |
| 5,305,490 | | 4/1994 | Lundgren | 15/167.1 |
| 5,339,482 | | 8/1994 | Desimone et al. | 15/167.1 |
| 5,353,464 | | 10/1994 | Atkins et al. | 15/167.1 |
| 5,355,546 | | 10/1994 | Scheier et al. | 15/167.2 |
| 5,373,602 | | 12/1994 | Bang | 15/167.1 |
| 5,392,483 | | 2/1995 | Heinzelmann et al. | 15/167.1 |
| 5,398,368 | | 3/1995 | Elder | 15/167.1 |
| 5,398,369 | | 3/1995 | Heinzelman et al. | 15/167.1 |
| 5,483,722 | | 1/1996 | Scheier et al. | 15/167.2 |
| 5,511,275 | | 4/1996 | Volpenhein | 15/167.1 |
| 5,533,227 | | 7/1996 | Ito et al. | 15/167.1 |
| 5,630,244 | | 5/1997 | Chang | 15/167.1 |
| 5,651,158 | | 7/1997 | Halm | 15/167.1 |
| 5,742,972 | | 4/1998 | Bredall et al. | 15/167.1 |
| 5,758,383 | | 6/1998 | Hohlbein | 15/167.1 |
| 5,761,759 | | 6/1998 | Leversby et al. | 15/167.1 |
| 5,774,923 | | 7/1998 | Halm | 15/167.1 |
| 5,813,079 | | 9/1998 | Halm | 15/167.1 |
| 5,839,149 | | 11/1998 | Scheier et al. | 15/167.2 |
| 5,946,759 | | 9/1999 | Cann | 15/167.1 |
| 5,991,958 | | 11/1999 | Hohlbein | 15/167.1 |
| 6,006,394 | | 12/1999 | Bredall et al. | 15/167.1 |
| 6,073,299 | | 6/2000 | Hohlbein | 15/167.1 |
| 6,115,870 | | 9/2000 | Solanki et al. | 15/167.1 |

FOREIGN PATENT DOCUMENTS

| | | | | |
|---|---|---|---|---|
| 0 577 656B1 | | 1/1994 | (EP) . | |
| 0 708 609B1 | | 5/1996 | (EP) . | |
| 442832 | | 9/1912 | (FR) . | |
| 792476 | | 12/1935 | (FR) . | |
| 1431088 | * | 1/1966 | (FR) | 15/167.1 |
| 2232284 | * | 1/1975 | (FR) | 15/167.1 |
| 471387 | | 9/1937 | (GB) . | |
| 71-844 | | 6/1971 | (KR) . | |
| 92/17092A1 | | 10/1992 | (WO) . | |
| 92/17093A1 | | 10/1992 | (WO) . | |
| 93/14671A1 | | 8/1993 | (WO) . | |
| 94/05183A1 | | 3/1994 | (WO) . | |
| 94/09678A1 | | 5/1994 | (WO) . | |
| 95/06420A1 | | 3/1995 | (WO) . | |
| 96/01577A1 | | 1/1996 | (WO) . | |
| 96/02165A1 | | 2/1996 | (WO) . | |
| 97/07706A2 | | 3/1997 | (WO) . | |
| 97/07707A1 | | 3/1997 | (WO) . | |
| 97/10938A1 | | 3/1997 | (WO) . | |
| 97/24048A1 | | 7/1997 | (WO) . | |
| 97/25900A1 | | 7/1997 | (WO) . | |
| 97/29663A1 | | 8/1997 | (WO) . | |
| 97/38840A1 | | 10/1997 | (WO) . | |
| 98/58563A1 | | 12/1998 | (WO) . | |
| 99/23910A1 | | 5/1999 | (WO) . | |
| 99/37182A1 | | 7/1999 | (WO) . | |
| 00/57747A1 | | 10/2000 | (WO) . | |

* cited by examiner

TOOTHBRUSH

FIELD OF THE INVENTION

The present invention relates to a bristle arrangement for a toothbrush, more particularly to a toothbrush whose head has tufts arranged in distinct groups separated by gaps which extend from one side of the brush head to the other. The placement and orientation of tufts is such that the groups can operate substantially without interference from neighbouring groups of tufts, yet a high overall density of tufts on the toothbrush head is still maintained.

BACKGROUND OF THE INVENTION

Effective brushing of teeth requires both high bristle contact with all tooth surfaces and penetration of bristles into interdental gaps and other crevices. Typical toothbrushes, with uniform tuft spacing across the brush head, achieve high bristle contact but interdental penetration is limited by interference between neighbouring tufts i.e. the whole set of bristles tends to behave as one solid array.

Various arrangements of bristles on the toothbrush head which aim to improve the quality of brushing have been described.

WO 91/19437, for example, describes a toothbrush with a three-dimensional bristle profile for improved interproximal cleaning. EP-A-449,653 and EP-A-449,655 disclose brushes having tufts which are set at an angle to the toothbrush head and to each other to clean the gingival marginal area and the interproximal spaces. It is also said that the tufts are unable to support one another structurally, allowing individual tufts to penetrate embrasures and interproximal spaces without being inhibited by surrounding bristle tufts. WO 96/01578 recites a multi-level bristle tuft which has the object of stimulating gums and imparting a unique mouth sensation signalling effective cleaning. WO 96/15696 is directed towards a toothbrush with strips of a flexible, resilient material projecting from the head which enhance its tooth cleaning effect.

Alternative approaches to improving cleaning have included modifying the shape or behaviour of the brush head. WO 91/19438, for instance, discloses a toothbrush with weakened regions in the head which allow it to be deformed to suit the particular size and shape of the user's dental arches. There are rows of bristles missing at the weakened regions. WO 96/02165 and other documents referenced therein describe brushes with flexible heads which can adapt or be adapted to the user's teeth whilst brushing. WO 94/09677 describes yet another variation wherein two general directional orientations of rectangular bristles are used on the same brush head in order to provide improved cleaning performance. The aforesaid document reviews earlier art describing the use of rectangular bristles to achieve different brushing characteristics for different motions of the brush.

Separately from all of this, the manner of using a toothbrush has received much attention from dental professionals over the years. Preferred methods for brushing teeth, such as the Bass and Rolling techniques are described in 'Primary Preventative Dentistry' by N. O. Harrison and A. G. Christen, 4th Edn., published by Appleton & Lange.

Despite all the foregoing, and much other literature on toothbrushes, there remains a need for improved brush designs.

It is accordingly an object of this invention to provide a toothbrush allowing independent movement of bristle tufts whilst maintaining a high overall density of tufts.

It is a further object of this invention to provide a toothbrush which allows independent movement of bristle tufts whilst achieving a preferred orientation of bristles to teeth surfaces whilst brushing.

It is yet a further object of this invention to provide a toothbrush whose head is comfortable within the mouth and which has a bristle arrangement that assists improved cleaning.

SUMMARY OF THE INVENTION

According to the present invention there is provided a toothbrush having a handle and, attached at one end thereof, a head, the head having a handle end, a free end, and a bristle-bearing face with a plurality of tufts extending therefrom, the tufts each having a base and a free end and comprising one or more bristles, wherein the tufts are arranged in groups which are separated from each other by a transverse gap, the distance between the bases of the tufts within a group being less than 1.3 mm, the distance between the bases of the tufts between groups being in the range from 1.3 mm to 5 mm and wherein the distance between the free ends of the tufts between groups is at least 0.5 mm.

According to a second aspect of the present invention there is provided a toothbrush having a handle and, attached at one end thereof, a resiliently flexible head, the head having a handle end, a free end, and a bristle-bearing face with a plurality of tufts extending therefrom, the tufts each having a base and a free end and comprising one or more bristles, wherein the tufts are arranged in groups which are separated from each other by a transverse gap, the distance between the bases of the tufts within a group being less than 1.3 mm and the distance between the bases of the tufts between groups being in the range from 1.3 mm to 5 mm.

The arrangements allows for independent movement of bristle tufts yet maintain a high density of tufts on the brush head.

DETAILED DESCRIPTION OF THE INVENTION

The toothbrush of this invention can be a single piece toothbrush, such as in a conventional manual design or it can have, for example, a replaceable head, such as in an electrical toothbrush, or the head can be fixed but have exchangeable bristle-bearing inserts. The toothbrush has a handle and, attached to one end thereof, a head. The design of the handle is not critical to the invention, it will generally be of conventional elongate shape. Preferably it will be ergonomically designed, building in such features as elastomeric inserts to improve the user's grip, and thumb or index finger rests to improve handling. In a preferred embodiment the handle has a neck portion which is arched sufficiently that the free working ends of the bristles, as described hereinafter, lie in substantially the same plane as the handle.

The toothbrush head has a bristle-bearing face with a plurality of tufts extending therefrom, a free end which has a tip, and a handle end. The head further has two opposed sides which extend from the free end of the head to the handle end. The handle end can be continuous with an elongated handle as in a single piece toothbrush or it can be adapted to connect to a separate handle. In any case the long axis of the handle defines a longitudinal axis of the head, with the free end and handle end being at opposite ends of the longitudinal axis. The head also has a transverse axis lying orthogonal to the longitudinal axis and generally parallel to the bristle-bearing face. References to transverse or longitudinal herein refer to directions which are respectively parallel to these transverse and longitudinal axes, unless indicated otherwise. Suitably, the head itself is also elongated, with its elongated axis also being a longitudinal axis. The toothbrush head can also comprise an exchangeable insert which fits into a supporting frame, such as described in EP-A-704,179. In this latter case, by 'head' is meant the combination of the frame and insert as would be assembled for use in brushing one's teeth.

By 'tuft', herein, is meant a set of one or more bristles fastened to the brush at a common point. Bristles for use herein can be made of any of the materials well known in the art. Suitable bristle materials herein include polyester and nylon, such as Dupont Tynex® 612 and Stylon® 612 from STP. The bristles are preferably of circular cross-section but can also be of other cross-sections including, but not limited to, rectangular, hexagonal and trilocular. Furthermore, the diameter and length of the bristles can vary within the usual dimensions known by a person skilled in the art. In preferred embodiments the bristles are of circular cross-section with a diameter of from 0.1 to 0.25 mm and length of from 7 to 15 mm, preferably 9 to 12 mm, with each tuft comprising from about 10 to about 50 bristles.

In such embodiments, each tuft is generally circular with a diameter of from about 1 to about 2 mm. Cutting and end-rounding of the bristles can be done using any of the methods commonly known in the art. As used herein, the term 'bristle' also includes other flexible strips of cleaning material such as those described in WO 96/15696, referenced above. In such cases a tuft will suitably comprise just one bristle. Fastening of the bristle tufts to the brush head can be done using any of the methods known in the art, such as fusion, stapling and injection moulding. Preferred processes herein are stapling and fusion. Each tuft has a base and a free end, the free ends of the tufts forming the working surface which is used to clean the teeth. As used herein, the 'base' of the tuft is that part of the tuft at which it meets the face of the brush head. It will be understood that a portion of the tuft extends below the base into the brush head, for the purpose of anchoring the tuft into the head. It is preferred for the head to comprise pre-moulded tuft holes for the purpose of accommodating that portion of the tuft in this way. The tuft holes can be of any section including square and rectangular but are preferably circular. Their depth and diameter will be chosen by the man ordinarily skilled in the art to suit the tufts to be inserted therein. Bristles inserted into a common tuft hole are considered to be fastened at a common point and to be part of the same tuft.

The head is of length L, the length being measured between the tip of the free end and a line drawn perpendicular to the long axis of the head just touching the tuft or row of tufts nearest the handle at the points of their base closest to the handle. Generally L will be in the range from about 15 to about 35 mm, preferably from about 20 to about 30 mm.

The tufts are arranged in a plurality of groups, N, with each group being separated from adjacent group(s) by a transverse gap; there being N−1 gaps. N is at least two, preferably from 3 to 5, more preferably 4. Each group comprises one or more tufts, preferably from about 5 to about 20 tufts, more preferably from about 7 to about 12 tufts. The total number of tufts is suitably from about 25 to about 50, preferably from about 30 to about 40, more preferably about 35. By 'transverse gap' is meant a region on the bristle-bearing face which is devoid of tufts and extends from one side of the head to the other, such that each gap has two ends, one located at each side of the head. The transverse gaps can be linear or non-linear, being determined by the pattern of tufts on the bristle-bearing face. A straight line drawn between the two ends of a gap is preferably parallel to the transverse axis of the head but can also be obliquely oriented to the transverse axis.

Within each group, the distance between the bases of neighbouring tufts is less than 1.3 mm, preferably from 0.6 to 1.2 mm, more preferably from 0.8 to 1.1 mm. Distances between the bases of the tufts, as referred to herein are measured from tuft edge to tuft edge along a straight line drawn between tuft centres along the bristle-bearing face. Distances between the free ends of the tufts, as referred to herein, are measured from tuft edge to tuft edge along a straight line drawn between tuft centres, parallel to the bristle-bearing surface, from the free end of the shorter tuft. Unless specifically defined otherwise, distances between tufts refer to distances between neighbouring tufts. By 'neighbouring tuft' is meant the closest nearby tuft.

The distance between the bases of neighbouring tufts in adjacent groups, that is, measured across the gap between groups, is in the range from about 1.3 mm to about 5 mm, preferably from about 1.5 to about 3.5 mm, more preferably from about 1.7 to about 3 mm. There can be some variation across individual pairs of tufts but all pairs, where the members of each pair are in different groups will be at least 1.3 mm part at their bases.

By having a relatively large distance between tufts in adjacent groups, the groups of tufts are able to operate independently of each other. That is, tufts from one group do not substantially obstruct tufts from an adjacent group. This allows tufts on the margins of the groups, in particular, to penetrate better into the interproximal gaps and other crevices. Nevertheless, a relatively high, overall density of tufts on the brush head is maintained by the relatively small distance between tufts within groups. This, in particular, provides for good bristle coverage on individual tooth surfaces.

To maximise the benefits of the invention it is necessary that, not only are the tufts spaced apart at the base, but also that they do not interfere at their free ends in a way which would impair their individual movement when the brush is use. For a conventional rigid brush head the distances between free ends of the tufts between groups should be at least 0.5 mm, preferably at least 1 mm, more preferably at least 1.7 mm. This condition is automatically satisfied when the tufts are parallel to each other and the bristles within a tuft do not diverge towards their free ends.

Tufts can be generally perpendicular to the bristle-bearing face of the toothbrush head, or inclined at a more pronounced angle. By 'generally perpendicular' is meant that the central axis of the tuft is oriented at an angle of no more than 10° to a perpendicular from the centre of the bristle-bearing face. Preferably at least 70%, more preferably at least 80% of the tufts are generally perpendicular to the bristle-bearing face of the toothbrush head. In especially preferred embodiments, all of the tufts are generally perpendicular to the bristle-bearing face of the toothbrush head such that they are all essentially parallel to each other. Tufts which are generally perpendicular to the bristle-bearing face give better cleaning because they are then generally applied more or less perpendicular to teeth surfaces. They are also less susceptible to 'splay', the tendency of bristle tufts to become flattened on repeated usage. Splayed tufts have an unsightly appearance and impair the cleaning effect of the brush. Some tufts, however, can be inclined at an angle of more than 10° to the bristle-bearing face. As an example, it may be desirable to have some tufts in the outer longitudinal rows inclined to the side of the brush head for more gentle cleaning of the gingival margins. Preferably tufts are not inclined towards each other, especially across the gap between groups, since this detracts from the benefit of the present invention.

On a resiliently flexible brush head, as described hereinafter, the need to have the distances between free ends of the tufts between groups be at least 0.5 mm can be relaxed. This is because during use, when pressure is applied to the brush, it tends to adopt a more convex configuration and the tuft free ends move apart from each other. Nevertheless, it is still preferred that the tuft free ends are at least 0.5 mm, preferably at least 1 mm, more preferably at least 1.5 mm apart.

The overall density of tufts on the brush head is a function of the size of the head and the number of tuft groups as well as the size of the gap between groups. In preferred embodiments, the average distance (G) between neighbouring tufts in adjacent groups is in the range from about 0.15*L/(N−1) to about 0.3*L/(N−1). That is, when there are fewer groups, and hence fewer gaps between groups, the gaps can be larger, though as gaps are increased above 5 mm they do not provide any significant improvement in individual movement of groups of tufts and they are wasteful of space. The average distance between neighbouring tufts in adjacent groups is determined by taking the numerical average of all distances between pairs of neighbouring tufts, where one member of each pair is located on each side of the gap between groups.

Both the overall bristle tuft density and the freedom of individual tufts to operate independently of each other can also be influenced by the shape of the tuft groups and the disposition of tufts within the groups. Although rectangular groups of bristles can be used, with bristle tufts arranged in conventional straight rows, better results are achieved if tufts within a group are at least partially offset from each other along the transverse axis. By 'at least partially offset' is meant that, for any particular tuft, there is no other tuft within a distance of 1.3 mm, preferably 1.5 mm, measured along a line parallel to the transverse axis, for at least 50% of the width of the tuft measured along the longitudinal axis. Especially, the distance to the next tuft is greater than 1.3 mm, preferably greater than 1.5 mm, for at least 70%, more preferably 100% of the width of the tuft. In preferred embodiments at least 50%, more preferably at least 70% of the total number of tufts are at least partially offset for either of the two directions along the transverse axis. In this way, when brushing using the recommended Bass technique, in which the brush is placed along the teeth and moved up and down, tufts can more easily move past each other, giving less resistance to up and down movement than to longitudinal movement of the brush. One way of practising such offset dispositions is to have groups of tufts in the shape of a parallelogram, wherein the gaps between the groups are generally straight but obliquely oriented to the long and transverse axes of the brush head. A preferred configuration is to have one or more of the groups of tufts in a crescent or chevron-shaped array. By 'crescent' and 'chevron-shaped' is meant an array which is symmetric about the long axis but with at least two longitudinal rows of tufts within the array longitudinally displaced from their neighbours by a distance which is at least 20% of the average width of the tufts so that the whole group generally has the appearance of an arc or a 'V' with an apex lying on or close to the central longitudinal axis. By making the groups to be a set of interlocking shapes, in which the gaps between groups are approximately parallel to each other, the overall tuft density is also maintained. In a preferred embodiment this is achieved by having at least N−1 of the groups of tufts in a crescent shaped array. One end group, preferably the one nearest the handle end, need not be so formed. It can, for example, be oval, diamond shaped or circular. A further advantage of crescent or chevron-shaped groups of tufts is that they more efficiently utilise the space on brush head with a pointed or rounded free end. For this reason it is especially preferred to have the apex of the crescent or chevron directed towards the free end of the head.

The working surface formed by the free ends of the tufts can be of any suitable shape, such as flat, concave or rippled. Preferably it is cut to a wave profile as described in WO 91/19437. More preferably, some of the outer rows of tufts will have a raised profile as described in WO 96/07343.

The toothbrush head of the present invention, is preferably resiliently flexible, as described for example in WO 96/02165. By 'resiliently flexible' is meant herein that when a 3 Newton force is applied to the free end of the head, the handle end being held fixed immediately behind the last transverse row of bristles, the free end will deflect through an angle (the flex angle) of at least 2°, preferably at least 5°, more preferably at least 10°, and that further, when the 3 Newton force is removed, the free end of the head will return to its original position without the application of external force. The flex angle is less 40°, preferably less than 30°, more preferably less than 20°. This has been found to give an acceptable degree of flexibility for users without exposing the hinges and elastomer-segment bonds to undue stress. It is also preferred that the toothbrush head has a concave bristle-bearing face in its unstressed state. A resiliently flexible brush head can better adapt to different profiles of teeth and its assists the penetration of individual tufts into interproximal gaps and other crevices. It is also preferred that the bristle-bearing face of the toothbrush head is concave along the longitudinal axis in its unstressed state. The radius of curvature can vary along the length of the head. The radius of curvature is preferably from 10 to 500 mm, more preferably from 15 to 250 mm, especially from 25 to 150 mm.

A further advantage of having relatively large gaps between groups is that the gaps can then accommodate transverse grooves on the bristle-bearing face for the purpose of making the head flexible, as described in WO 96/02165. The grooves allow the head to flex or bend. The grooves can be linear or non-linear, but will preferably follow the shape of the gap.

In preferred embodiments herein, the toothbrush head comprises a transverse grooves in each of the gaps between groups of tufts so that the head can bend along the long axis. This allows the toothbrush head to flex so that it can acquire a convex profile along the long axis when pressed against the teeth. This makes it particularly suitable for brushing the lingual or inside surfaces of the teeth. Preferably there are matching grooves on the reverse face of the brush and the grooves are preferably filled with an elastomer as described in WO 96/02165. A preferred manner of constructing a flexible brush head is in accordance with our co-pending patent application GB 9601013, briefly summarised below for the purpose of better describing the best mode of practice of a brush according to the present invention.

The brush head has a pair of opposing faces, one of the pair being a bristle-bearing face with bristles attached to and extending from the face. The head comprises two or more flexibly connected segments, with grooves between the segments, to allow the head to flex under the action of brushing and accommodate itself to, for example, the differing profiles of individual users' teeth. The head further includes elastomer contained within the grooves on at least one face. The elastomer can improve the resilience of the head by acting like a spring, so that when a force applied to bend the head is removed, the head returns within a short period of time to its original configuration. The grooves define hinges between the segments. The hinges are preferably located between the faces, preferably at a distance of at least about 10% of the depth of the head from each of the faces, rather than being co-extensive with either of the faces. The elastomer can also act to limit the degree of bending so that when high levels of force are applied the head flex is limited, largely reducing the incidence of excess strain on the hinges and thereby improving the durability of the product.

The head and handle are generally made of relatively non-compressible materials, preferably with a modulus of elasticity of at least about 500 MPa, more preferably at least about 1000 MPa, which are conventional in the manufacture of toothbrushes, especially plastics materials. Suitable plastics materials include, for example, polyamides and polypropylenes. Polypropylene is preferred. Suitable polypropylenes include the material 'Polypropylene PM 1600' (marketed by Shell), having a modulus of elasticity (ISO 178) of 1500 MPa and Apryl 3400 MA1 from Elf Atochem. Preferably, a foaming agent such as Hydrocerol HP20DP from Boehringer-Mannheim is mixed with the polypropylene at a level of from about 1% to about 3%, preferably from about 1.5% to about 2.5%, by weight of the polypropylene. The foaming agent assists the flow of the polypropylene during moulding and, in particular, helps to ensure uniform formation of the hinges. The handle itself is generally rigid and may be of a shape which is conventional in the manufacture of toothbrushes. Optionally, the handle can comprise a neck portion which is more flexible than the rest of the handle, as known in the art, provided that it is sufficiently rigid that, in use, when force is applied to the head, particularly when brushing the teeth, the head still flexes in the manner and to the extent described below.

The brush head includes grooves on the bristle-bearing face and the opposing face, the grooves being the spaces between the segments. The grooves allow the head to flex or bend. The grooves can be oriented transverse or parallel to the longitudinal axis of the handle and can be linear or non-linear, such as curved or zigzag. Non-linear grooves help to offset compression stress in the elastomeric material filling the grooves as the head bends. The term 'transverse grooves' can also encompass grooves whose main axis, as defined by the straight line joining the start and endpoints of the grooves is offset from the transverse axis of the head by an angle of up to and including 45°. Similarly, the term 'longitudinal grooves' can also encompass grooves whose main axis, is offset from the longitudinal axis of the head by an angle of up to 45°.

In preferred embodiments the brush head comprises one or more transverse grooves on each of the opposed faces so that the head can bend along the longitudinal axis. This allows the brush head to flex so that it acquires a convex profile along the longitudinal axis when pressed against the teeth. This makes it particularly suitable for brushing the lingual or inside surfaces of the teeth.

The brush head can also comprise one or more longitudinal grooves. Longitudinal grooves can allow, for example, the outer longitudinal rows of bristles to flex away from the inner ones.

In especially preferred embodiments the brush head comprises both transverse grooves on each of the opposed faces so that the head can bend along the longitudinal axis and at least one longitudinal groove which connects the transverse grooves to permit the elastomer to flow from one groove to the other during the moulding process. In a single-piece brush with a co-moulded handle, this longitudinal groove can extend along the handle so that the same elastomer injection point in the mould that is customarily used for supplying elastomer to form handle grips can also be used to inject the elastomer for the grooves of the head. The longitudinal groove preferably runs along the back of the head, that is, on the face opposed to the bristle-bearing face, so that it does not interfere with tufting.

Grooves on one of the two opposing faces can be directly opposed to grooves on the other face or partially or wholly offset. Preferably, the grooves are directly opposed or only partially offset.

The grooves, which separate the segments of the head, also define hinges, which are thinned regions of the head at the base of the grooves.

The grooves can be of variable width and depth and the distances between grooves can also be varied. In this manner the flexibility of the head along the length and/or across the breadth of the head can be modified. Preferably only transverse grooves are varied in this way. Changing the depth of the grooves controls the location and thickness of the hinges which connect the segments. For a toothbrush head of between about 4 to about 6 mm thickness, typically about 5 mm, suitable groove depths are in the range from about 1.4 to about 3 mm, preferably from about 1.5 to about 2.8 mm. Suitable hinge thicknesses are in the range from about 0.4 to about 2.0 mm, preferably from about 0.5 to about 1.5 mm. Where transverse grooves are used then, desirably, the hinges which are or will be nearer to the handle are less flexible than those which are or will be more remote from it. In this way more uniform bending of the head can be achieved. The variation in flexibility can be achieved by varying the hinge thicknesses. In a preferred embodiment the hinge nearest the handle is up to about 3 times, preferably up to about 2 times as thick as the hinge most remote from the handle. An exemplary set of hinge thicknesses for a toothbrush with 3 transverse grooves are respectively about 1.1, 0.6 and 0.6 mm reading from the handle end. If identical hinges are used along the brush head then there is a tendency for flexing of the head to occur predominantly at the hinge nearest the handle. The depth of grooves on the bristle bearing face can be different to those on the opposing face. Preferably the grooves on the bristle-bearing face are less deep than those on the opposing face. In embodiments where there is elastomer in the grooves on both faces, this allows more elastomer to be put under compression than under tension. The elastomer to segment bonds are stronger under compression than under tension.

Increasing the width of the grooves increase the gap between the segments and therefore the length of the hinges, which increases their flexibility. However, since it is preferred to insert bristles into the segments rather than into the elastomer, increased groove length also leaves less space for the bristles, within a given head size. Suitable groove widths are in the range from about 0.3 to about 3.0 mm, preferably from about 1.2 to about 2.0 mm. The grooves are preferably tapered slightly inwards towards the bottom of the groove, suitably converging at an angle of from about 3 to about 10°, to facilitate moulding. As the brush is flexed the width of the groove changes, more rapidly at the top of the groove than at the bottom of the groove, the relative change being a function of the groove width and depth. Since this change in groove width results in compression or tension of elastomer contained within the groove, it can be seen that, for a given elastomer, the groove geometry can be used to control the head flexibility.

The hinges can be the full length of the grooves or, preferably, there can be one or more gaps in or to the side of the hinges the grooves in these regions being the full depth of the head. This has the advantage of permitting a single injection point for the elastomer when moulding the head. The gap allows elastomer to flow from one face to the other during the moulding process. In a preferred embodiment, the hinges are discontinuous, with two or more hinges, preferably just two, connecting each segment to its neighbour or to the handle. In this embodiment there are gaps between the hinges and to each side. In linear grooves, the hinge widths are not generally critical, provided that they are such that gaps are still created, however, wide hinges can be subject to distortion if they are used within a non-linear groove. Suitable hinge widths are in the range from about 0.5 to about 4.0 mm, preferably from about 1.0 to about 3.0 mm.

It is preferred that each hinge is located between the two faces and at a distance of at least about 10%, preferably at least about 20%, more preferably at least about 30% of the depth of the head from each of the faces. The distance of the hinge from the face is measured by the perpendicular line drawn from the top of the face to the nearest boundary surface of the centre of the hinge. Locating the hinges away from the faces of the brush means that they are subject to less stretching or compression as the head is flexed and improves their durability. In a particularly preferred embodiment, the brush head has transverse grooves which are arranged in pairs such that one member of each pair is on each face and directly opposes the other member of the pair, with one or more hinges therebetween connecting the segments so that each hinge is located between the two faces and at a distance of at least about 10%, preferably at least about 20%, more preferably at least about 30% of the depth of the head from each of the faces.

The grooves on at least one face of the brush contain elastomer. This can be achieved by a separate injection moulding step after the moulding of the segments of the head has been completed. Preferably, all of the elastomer is injected from a single injection point. However, there can be separate elastomer injection points in the mould to supply the elastomer for discrete elastomer elements in the head, for example one to supply elastomer to the bristle-bearing face and a further injection point to supply elastomer to the opposing face. Thus when the head is flexed in a direction orthogonal to the opposed faces, the elastomer is put either under tension or under compression. The elastomer has the effect of limiting the head flexibility thereby reducing the stretching or compression of the hinges and of limiting the stress at the bond between the elastomer and the head segments. A more durable head is thus obtained. Preferably, grooves on both the bristle-bearing face and the opposing face contain elastomer so that elastomer is put under compression whichever direction is chosen. The elastomer on the opposed face is of course put under tension but the tensile stress on the elastomer to segment bonds is limited and is shared with the hinge material.

Preferably all of the grooves are wholly filled with the elastomer, generally by a separate moulding process after the moulding of the head segments has been completed. Complete filling of the grooves has an advantage of, for example, avoiding contamination of the grooves by toothpaste deposits. The grooves can be partially filled though, provided that sufficient elastomer is used to give effective moderation of the flexibility of the head.

Suitable elastomers include thermoplastic elastomers with a Shore hardness of 30–80 and a modulus of elasticity of less than about 500 MPa, preferably less than about 300 MPa, such as Santoprene and Thermoflex. An exemplary elastomer is 'PTS Thermoflex 75' (marketed by Plastic Technologie Service, Germany), having a modulus of elasticity (ISO 178) of 100 MPa and a hardness (ISO 868) of 80 Shore A. Elastomers PL12291, PL12292, and PL12293 (marketed by Multibase, Saint Laurent Du Pont, France) are also suitable for use herein. In general, choosing the elastomer so that is based upon the same chemical class of polymers as material of the head segments assists in bonding the elastomer to the head segments. For example, when the head segments are made from polypropylene, the elastomer is preferably based upon polypropylene. The elastomers can optionally be mixed with a suitable plasticiser or foaming agent to make them more compressible. The colour of the elastomer material can be the same as that of the head segments, or it may be different thereby achieving a distinctive striped or otherwise patterned appearance.

The present invention will now be described by way of example only, with reference to the accompanying drawings in which.

Figure 1:
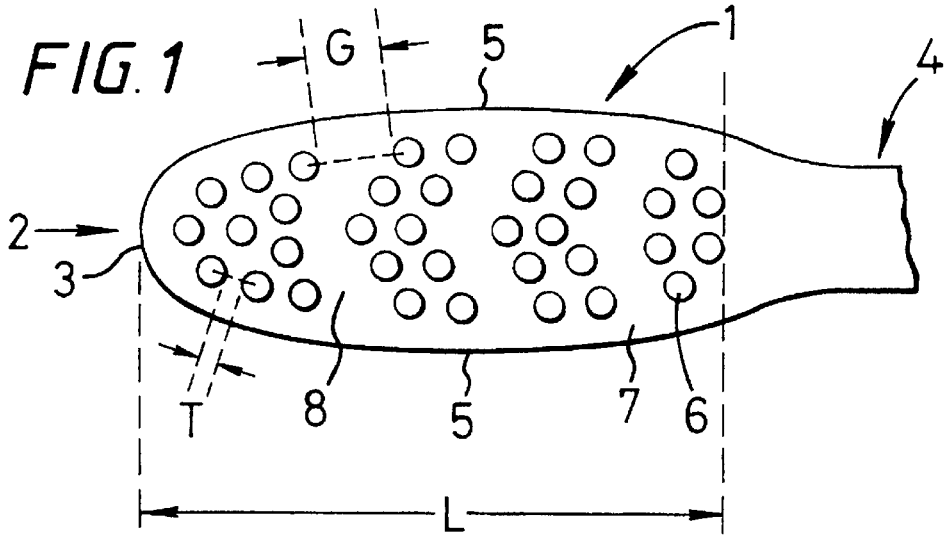
FIG. 1 is a plan view of a first embodiment of the invention showing the layout of the tufts on the toothbrush head.

Referring to FIG. 1, a toothbrush head 1 has a rounded free end 2, having tip 3, handle end 4, and sides 5 extending from free end to handle end. A plurality of tufts 6 extend from the bristle-bearing face 7. The tufts are arranged in four groups separated from each other by gaps 8. The three groups nearest the free end are each in the form of a crescent shaped array. The group nearest the handle end is generally in the shape of an oval or diamond.

Within each group the tufts are relatively closely spaced, the distance T between the bases of neighbouring tufts varying from 0.6 to 1 mm. Neighbouring tufts in adjacent rows are offset from each other along the transverse axis so that their free ends can more easily move past each other when brushing via the Bass technique. The distance between the bases of neighbouring tufts in adjacent groups varies from 1.9 to 3 mm. The length, L, of the head is 29.6 mm.

Figure 2A:
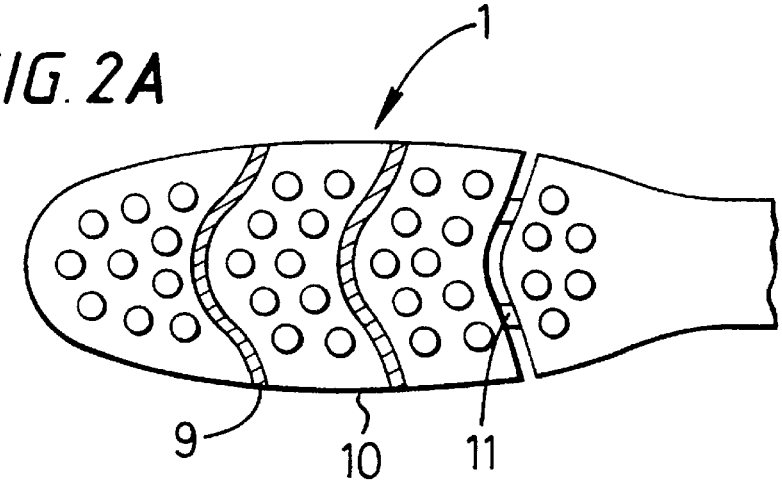
FIG. 2A is a plan view of another embodiment with elastomer filled transverse grooves placed within the gaps between groups of tufts.
Figure 2B:
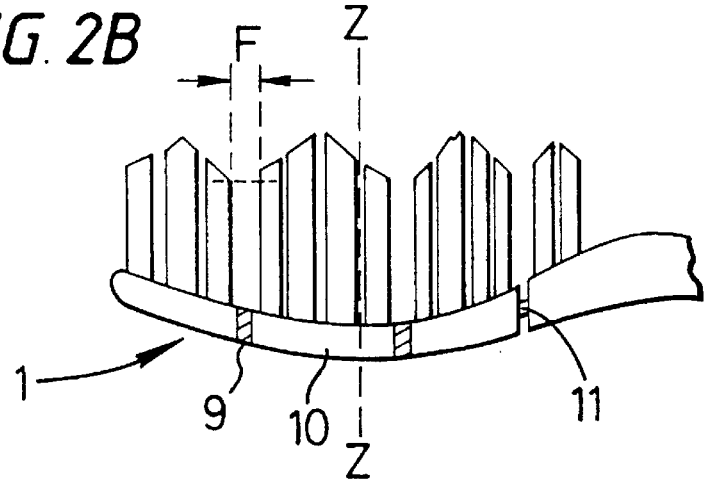
FIG. 2B is a side view of the embodiment of FIG. 2A, elastomer in the groove nearest the handle is not shown in order to reveal the hinges.

Referring to FIGS. 2A and 2B, the toothbrush head 1 has elastomer filled grooves 9 which make the head 1 resiliently flexible. When a 3 Newton force is applied to the tip of the free end of the head, the handle end being held fixed immediately behind the last transverse row of bristles, the free end deflects through an angle of 15° and, when the 3 Newton force is removed, the free end of the head returns to its original position without the application of external force. The bristle-bearing face of the head is concave along the longitudinal axis in its unstressed state, having a radius of curvature of 75 mm. The grooves 9 divide the head into segments 10. The segments are connected only by pairs of thin hinges 11. For the sake of clarity only the hinges in the groove nearest the handle end are shown, the others being obscured by elastomer. The tufts are arranged in four groups separated from each other by gaps 8. The three groups nearest the free end are each in the form of a crescent shaped array. The group nearest the handle end is generally in the shape of an oval or diamond. The tufts are all generally perpendicular to the bristle bearing surface, that is, the central axis of each tuft is oriented at an angle of no more than 10° to a perpendicular, shown by the line Z—Z in FIG. 2B, from the centre of the bristle-bearing face. This has the result that the distance (F) between the free ends of the tufts is essentially the same as the distance between the bases. Because the bristle-bearing face of the head is concave in its unstressed state, the tufts at each end of the head, though parallel to the central axis (Z—Z), and to each other, are not perpendicular to the bristle-bearing surface at their point of attachment. According to a further aspect of the invention it is preferred to mould a curved brush head with tuft holes which are all axially parallel to the axis Z—Z. This has the benefit that during the moulding process, the pins which are used to create the tuft holes are more easily removed from the moulded brush body without distortion of the tuft holes.

Figure 3:
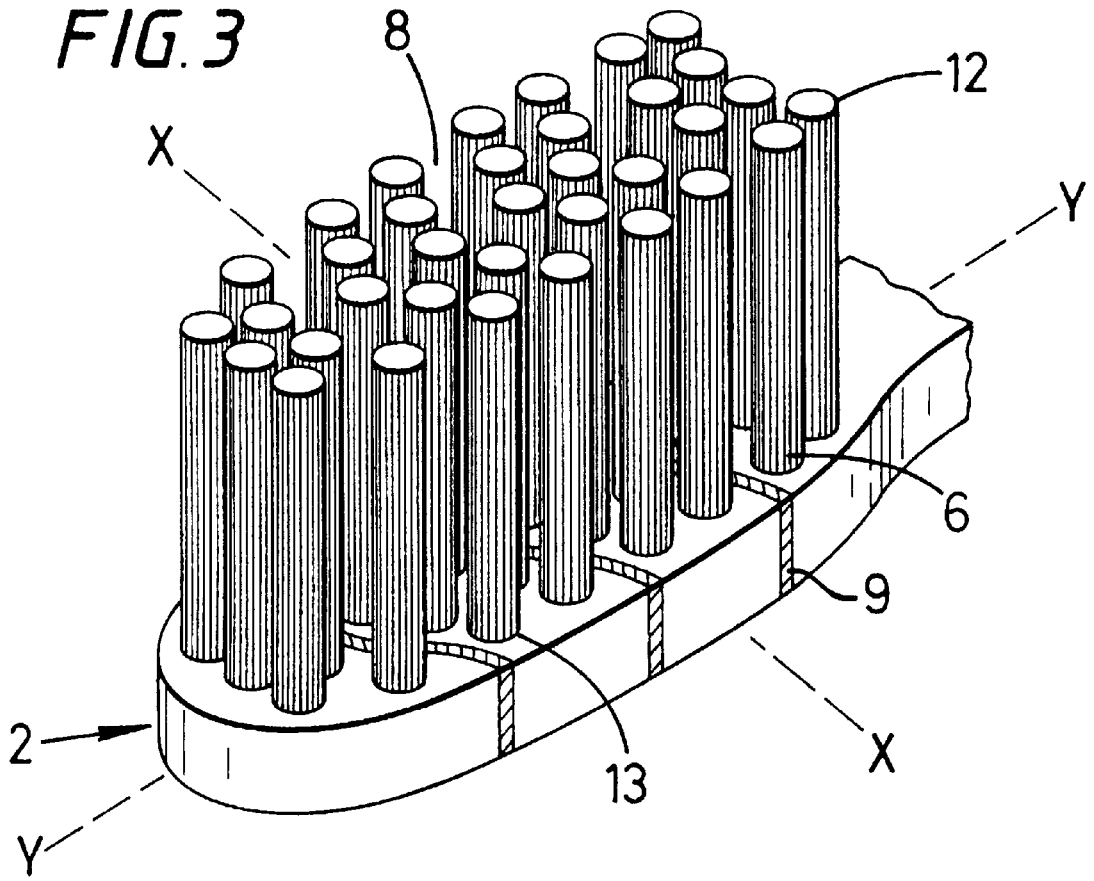
FIG. 3 is a perspective view of a toothbrush head according to the invention.

FIG. 3 shows an embodiment of the brush head, having a transverse axis (X—X) and a longitudinal axis (Y—Y), wherein thirty-five bristle tufts 6 are arranged in four groups with transverse gaps 8 between the groups. The tufts are arranged in four groups separated from each other by gaps 8. Each group is in the form of a crescent shaped array. The tufts are all perpendicular to the bristle-bearing face of the head and are substantially of the same length so that their free ends 12 form a flat working surface. Within each group the tufts are relatively closely spaced; the distance between the bases 13 of neighbouring tufts varies from 0.7 to 1 mm. The tufts are symmetrically disposed about the long axis Y—Y of the head. Whichever direction is chosen along the transverse axis, for thirty of the tufts the there is no tuft within 1.3 mm, measured along a line parallel to the transverse axis for at least 60% of the width of each tuft. For reasons of symmetry, the central two tufts within the rows containing four tufts lie on the same transverse axis. The tufts in the row nearest the free end 2 of the head are slightly offset from each other. The head comprises elastomer filled transverse grooves 9 which lie in the gaps between the groups.

Figure 4:
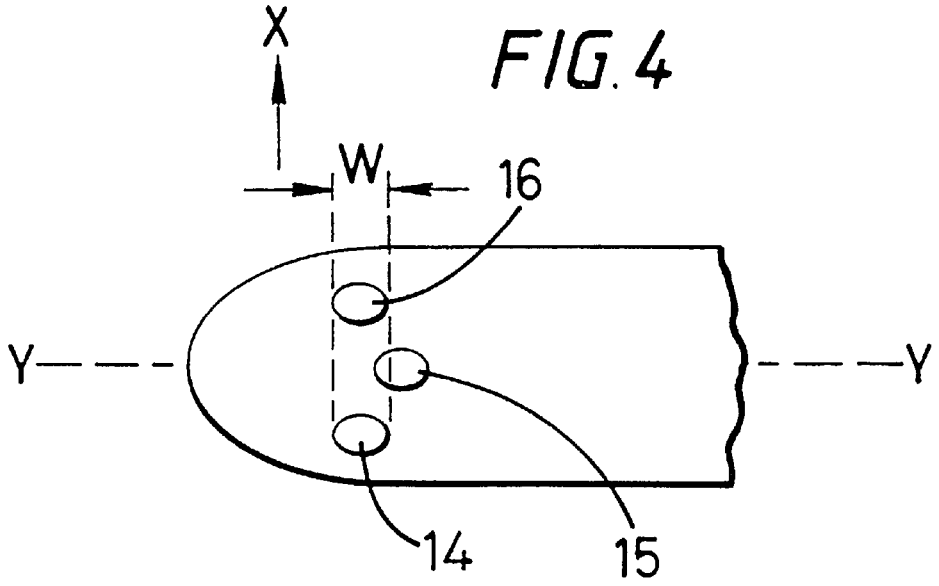
FIG. 4 is a schematic plan view showing the measurement of offsets of tufts along the transverse axis.

FIG. 4 shows a part plan view of a head where, for reasons of clarity, only three tufts, 14, and 16, are shown. The transverse axis lies perpendicular to longitudinal axis (Y—Y). Tuft 14 has width W, measured along the longitudinal axis. Looking along the transverse axis in direction X, for 70% of the width W, the next tuft to tuft 14 is tuft 16, which is at least 2 mm away for the full width W. However, for 30% of width W, the transverse projection of tuft 14 overlaps with tuft 15 which is less than 1.3 mm away along direction X. The same analysis applies to tuft 15 in respect of tuft 16. For tuft 16, since it is in an outer row, there is no tuft in the direction X.

What is claimed is:

1. A toothbrush having a handle and, attached at one end thereof, a head, the head having a handle end, a free end, and a bristle-bearing face with a plurality of tufts extending therefrom, the tufts each having a base and a free end and comprising one or more bristles, wherein the tufts are arranged in groups which are separated from each other by a transverse gap, the distance between the bases of the tufts within a group being less than 1.3 mm, the distance between the bases of the tufts between groups being in the range from 1.3 mm to 5 mm and wherein the distance between the free ends of the tufts between groups is at least 0.5 mm; and wherein the average distance, G, between tufts in adjacent groups is in the range from about 0.15*L/(N−1) to about 0.3*L/(N−1), where L is the length of the head and N is the total number of groups of tufts.

2. A toothbrush according to claim 1, wherein the head further comprises one or more grooves located in the gaps.

3. A toothbrush according to claim 1, wherein more than 80% of the tufts are oriented generally perpendicular to the bristle-bearing face.

4. A toothbrush having a handle and, attached at one end thereof, a resiliently flexible head, the head having a handle end, a free end, and a bristle-bearing face with a plurality of tufts extending therefrom, the tufts each having a base and a free end and comprising one or more bristles, wherein the tufts are arranged in groups which are separated from each other by a transverse gap, the distance between the bases of the tufts within a group being less than 1.3 mm and the distance between the bases of the tufts between groups being in the range from 1.3 mm to 5 mm; and wherein the average distance, G, between tufts in adjacent groups is in the range from about 0.15*L/(N−1) to about 0.3*L/(N−1), where L is the length of the head and N is the total number of groups of tufts.

5. A toothbrush according to claim 4, wherein at least N−1 groups of tufts are in the form of a crescent or chevron-shaped array, where N is the total number of groups of tufts.

6. A toothbrush according to claim 4, wherein the head further comprises one or more grooves located in the gaps.

7. A toothbrush according to claim 4, wherein more than 80% of the tufts are oriented generally perpendicular to the bristle-bearing face.

8. A toothbrush having a handle and, attached at one end thereof, a head, the head having a handle end, a free end, and a bristle-bearing face with a plurality of tufts extending therefrom, the tufts each having a base and a free end and comprising one or more bristles, wherein the tufts are arranged in groups which are separated from each other by a transverse gap, the distance between the bases of the tufts within a group being less than 1.3 mm, the distance between the bases of the tufts between groups being in the range from 1.3 mm to 5 mm and wherein the distance between the free ends of the tufts between groups is at least 0.5 mm; and wherein one or more of the groups of tufts forms a crescent or chevron shaped array.

9. A toothbrush according to claim 8, wherein at least N−1 groups of tufts are in the form of a crescent or chevron-shaped array, where N is the total number of groups of tufts.

10. A toothbrush according to claim 8, wherein the head further comprises one or more grooves located in the gaps.

11. A toothbrush according to claim 8, wherein more than 80% of the tufts are oriented generally perpendicular to the bristle-bearing face.

12. A toothbrush having a handle and, attached at one end thereof, a resiliently flexible head, the head having a handle end, a free end, and a bristle-bearing face with a plurality of tufts extending therefrom, the tufts each having a base and a free end and comprising one or more bristles, wherein the tufts are arranged in groups which are separated from each other by a transverse gap, the distance between the bases of the tufts within a group being less than 1.3 mm, the distance between the bases of the tufts between groups being in the range from 1.3 mm to 5 mm; and wherein one or more of the groups of tufts forms a crescent or chevron shaped array.

13. A toothbrush according to claim 12, wherein the apex of the crescent or chevron is directed towards the free end of the head.

14. A toothbrush according to claim 12, wherein the head further comprises one or more grooves located in the gaps.

15. A toothbrush according to claim 12, wherein more than 80% of the tufts are oriented generally perpendicular to the bristle-bearing face.

* * * * *